US005766001A

United States Patent [19]

Bentsen

[11] Patent Number: 5,766,001

[45] Date of Patent: Jun. 16, 1998

[54] GRATE ELEMENT FOR A GRATE SURFACE, E.G. IN A CLINKER COOLER

[76] Inventor: Bo Bentsen, Vigerslev Alle 77, Valby, Copenhagen, Denmark, DK-2500

[21] Appl. No.: 375,862

[22] Filed: Jan. 20, 1995

[51] Int. Cl.[6] ..... F27D 15/02

[52] U.S. Cl. ..... 432/78; 110/281; 110/291

[58] Field of Search ..... 432/77, 78; 110/281–283, 110/289–291

[56] References Cited

U.S. PATENT DOCUMENTS

| | | | |
|---|---|---|---|
| 4,870,913 | 10/1989 | Schneider | 110/291 |
| 5,299,555 | 4/1994 | Claes | 110/291 |
| 5,433,157 | 7/1995 | Dittmann et al. | 110/281 |
| 5,549,471 | 8/1996 | Tegtmeier et al. | 432/78 |
| 5,551,356 | 9/1996 | Post | 432/78 |

*Primary Examiner*—Erick R. Solis
*Attorney, Agent, or Firm*—Daniel De Joseph

[57] ABSTRACT

A grate element (1) for a grate surface, e.g. in a clinker cooler, is shaped in the form of a box between the walls (3, 4) of which a number of grate surface-defining grate slats (5, 6) are mutually arranged so that, between them, they form fine gas slots (7). Under each of these slots (7) the grate element 1 comprises an L-shaped slat (9) the ends of which are fixed to the side walls (3, 4) and the body (6) of which is fixed along its entire length to the overlying grate slat (5) so that the foot (12) of the L-shaped slat is positioned parallel to the grate slats (5).

Hereby it is obtained that the grate element is effectively cooled, that the pressure loss through the grate element is appropriately large, that the grate element is protected against falling-through of material and that maintenance work in connection with the replacement of grate elements is facilitated.

12 Claims, 2 Drawing Sheets

GRATE ELEMENT FOR A GRATE SURFACE, E.G. IN A CLINKER COOLER

Figure 1:
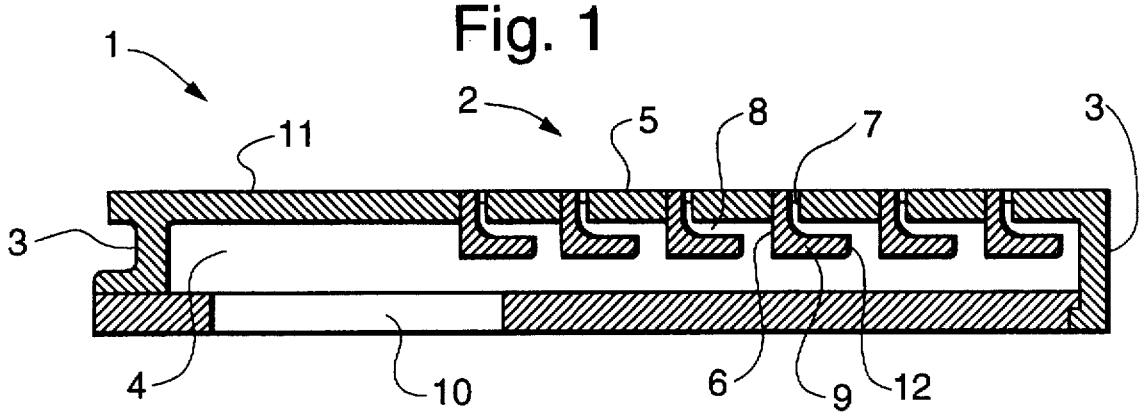

This application claims benefit under 35 USC 120 of the filing date of PCT/US/93/09445, filed on Oct. 5, 1993, which claims priority from Danish 1229/92 filed on Oct. 6, 1992.

The invention relates to a grate element for a grate surface, e.g. in a clinker cooler, which grate element is shaped in the form of a box, between the walls of which a number of grate surface-defining grate slats are mutually arranged so that, between them, they form fine gas slots.

The function of the grate surface of a clinker cooler, which often comprises a large number of grate elements, is partly to convey clinker material through the cooler and partly to allow the cooling gas to penetrate the clinker material for cooling hereof. The cooling gas is traditionally supplied to all the grate elements of the grate surface via one or very few common, underlying chambers. Given that, in most cases, the clinker material is not homogenous with respect to size, the clinker layer on the grate surface will not be distributed in an even and homogeneous manner, and, therefore, the passage of cooling gas through the different areas of the clinker layer will be very uneven, involving risk that socalled "red rivers", i.e. sections of insufficiently cooled clinker, will be formed.

In order to resolve this problem, it has been proposed to provide each grate element in the grate surface separately with cooling gas so that the passage of gas through each single grate element can be controlled so that an even distribution of the gas across the entire grate surface is achieved. It has also been proposed to provide for a significantly greater pressure loss through the grate surface than through the clinker layer whereby it will mainly be the pressure loss through the-grate surface which determines the gas distribution across the grate.

A grate element of the above kind is known from the EP patent application No. 167658, which comprises longitudinal lateral brackets which define the width of the grate and a number of grate bars or grate slats which are fixed between and transversely to the brackets, hence forming, between them, a plane surface with transverse gas slots. However, this grate element has the disadvantage that its construction will not ensure a sufficient cooling of the grate surface per se, and, therefore, the wear induced as a result of the hot clinker being deposited directly on the grate surface will be relatively large. Further, this known grate element is not constructed in such a way that it prevents falling-through of clinker material. A further disadvantage relates to the manner in which the grate elements are mounted, which makes it difficult to replace the individual grate element, partly because the single grate elements consist of two parts which have to be pushed together, and partly because a whole row of grate elements is assembled by means of common, through-going cross bolts.

It is the object of the invention to provide a grate element which is so constructed that it will ensure a sufficient pressure loss through the grate and hence a sufficient cooling of the grate surface, and prevent material from falling through the grate, while simultaneously ensuring uncomplicated mounting and replacement of the grate elements.

According to the invention this object is achieved by a grate element of the kind described in the introduction, being characterized in that a slat having an L-shaped cross section is fixed under each gas slot and in contact with a grate slat, the body of the L-slat being directed towards the grate slat, and the foot of the L-slat extending substantially parallel to the grate slats for formation of a gas channel.

It is hence ensured that the cooling gas is led through the grate element in such a manner that the surface-defining grate slats, which are the parts of the grate element exposed to the greatest thermal load, are effectively cooled. This is due to the fact that the largest pressure loss through the grate element is generated under these grate slats, which is in accordance with the Reynolds analogy which states that "a greater pressure loss will result in greater heat transfer and vice versa". Also, the construction of the grate element ensures against falling-through of material in that the L-shaped slats, the feet of which form the lower walls of the gas channels, provide a so-called "water trap effect", hence preventing falling-through of material, even when the gas supply is interrupted. The simple construction of the grate will further facilitate the maintenance work since it will be possible to replace a single damaged grate element without having to remove any of the surrounding grate elements.

The grate slats which constitute the grate surface are preferably cast in one piece with the walls of the grate element, but may also be separately manufactured and fixed by means of suitable fastening means. However, the slats with an L-shaped profile are preferably manufactured on a separate basis and fixed to the walls of the grate element by welding.

The water trap effect of the grate element, which prevents falling-through of material, can be enhanced by providing the L-shaped slats at their free sides with longitudinal, projecting beads and/or by providing the grate slats at their free sides with corresponding longitudinal, descending beads. Hence the grate element can be formed so that the gas inlet of each gas channel is situated at a higher level than a partial section of the gas channel per se.

The water trap effect can be enhanced further by providing recesses both in the grate slats and in the surfaces of the L-shaped slats being positioned opposite to a bead, and by sizing the beads so that they protrude into these recesses.

Figure 2:
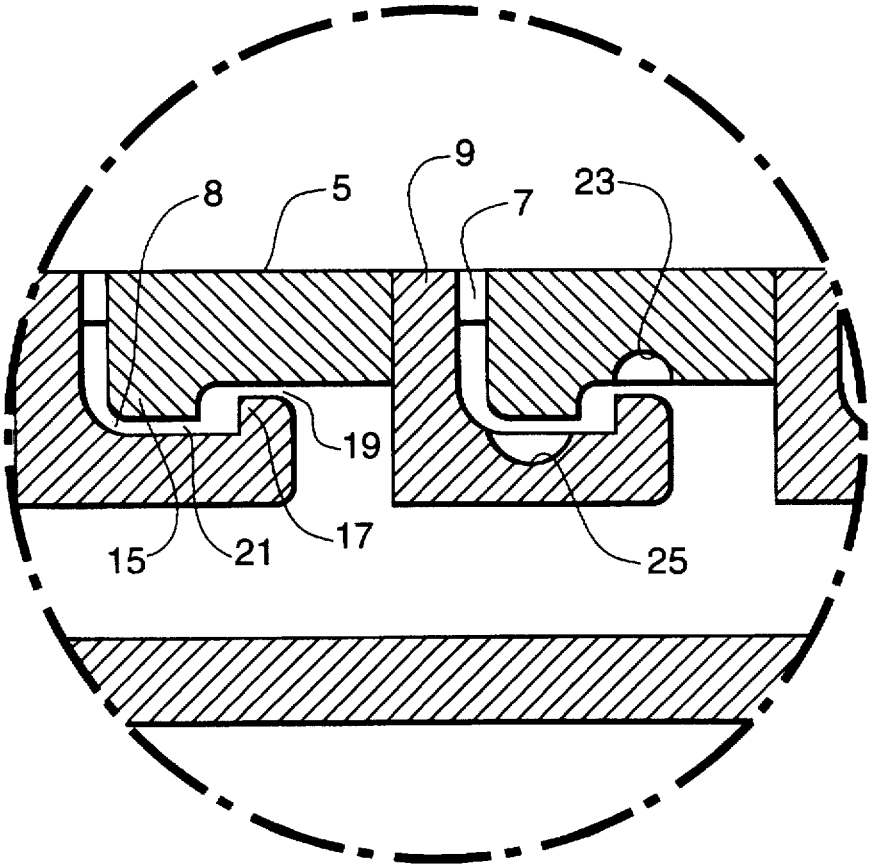
Figure 3:
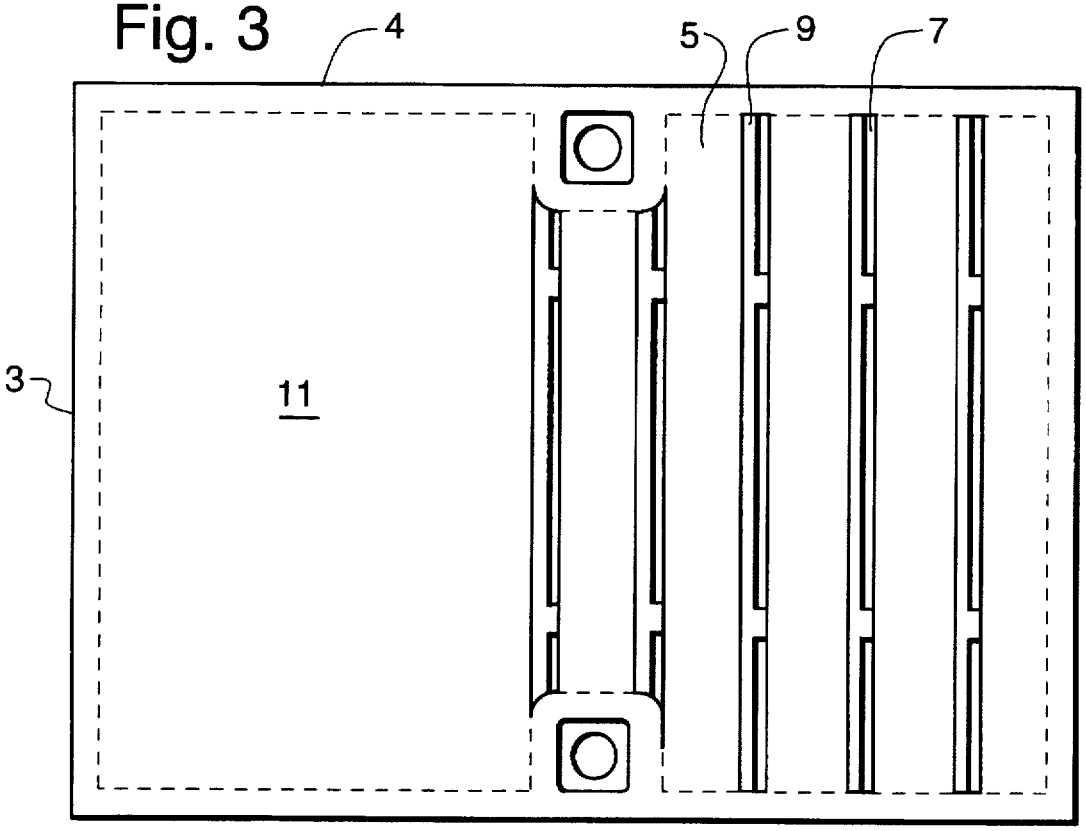
Figure 4:
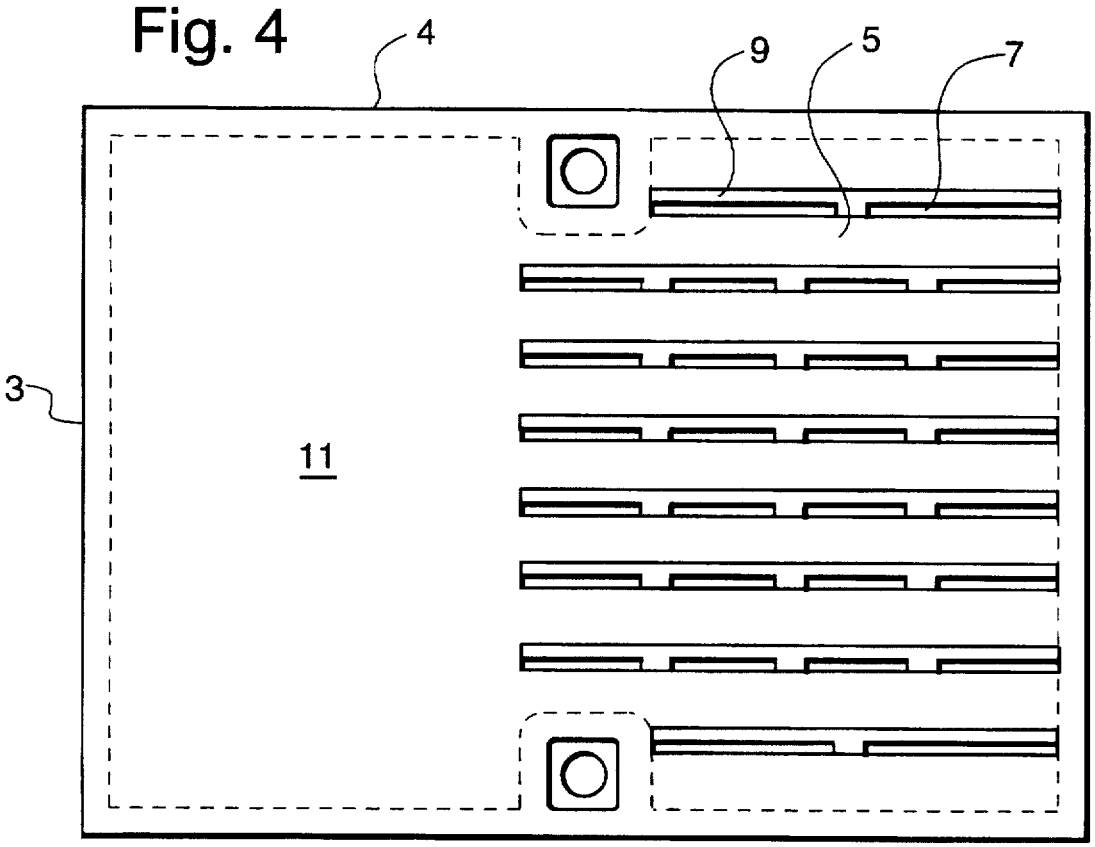

The invention will now be described in further details with reference to the accompanying drawing, being diagrammatical, and where FIG. 1 shows a longitudinal section of a first embodiment of a grate element according to the invention, FIG. 2 shows on a larger scale a section of a modified embodiment of the grate element according to the invention, FIG. 3 shows a plan view of an embodiment of a grate element according to the invention where the grate slats are mounted transversely to the direction of movement of the material, and FIG. 4 shows a plan view of an embodiment of a grate element according to the invention where the grate slats are mounted longitudinally in the direction of movement of the material.

The grate element 1 shown in FIGS. 1 and 3 is constructed as a box with end walls 3 and side walls 4, comprising transverse bars or slats 5 extending between the side walls 4, and forming the active surface 2 of the grate element. As shown, the slats 5 are spaced apart in order to provide gas slots 7 between them. Under each of these slots 7, the grate element 1 comprises, as is best seen in FIG. 1, an L-shaped slat 9 the ends of which are fixed to the side walls 4 and the body 6 of which is fixed along its entire length to the overlying grate slat 5 in such a way that the foot 12 of the L-shaped slat is pointing forward and is parallel to the grate slats 5. In this way, each L-shaped slat forms a gas channel 8 together with the overlying slat 5. Via an opening 10 at the bottom, the grate element 1 is supplied with cooling gas which flows through the gas channels 8, the slots 7 and upstream through the material deposited on the grate surface 2. The grate element further comprises a not cooling-active surface 11 which is overlapped by a not shown preceding grate element.

As is apparent from the modified embodiment of the grate element 1 shown in FIG. 2, the surface-defining slats 5 as well as the L-shaped slats 9 may be provided with beads 15 and 17, respectively. These beads 15, 17 extend along the full length of the slats and provide the grate element 1 with a water trap effect which prevents falling-through of material in that the gas inlet 19 of each gas channel 8 is situated at a higher level than a partial section 21 of the gas channel 8 per se.

In order to increase this water trap effect, the grate element 1 in the surfaces of the slats 5, 6, which are pointing towards the beads 15, 17, may comprise recesses 23, 25 into which the beads 15, 17 protrude.

When utilizing the grate element 1 in a clinker cooler, the cooling gas, usually atmospheric air under pressure, will flow from a not shown gas supply beam through the opening 10 and the gas channels 8 up through clinker material (not shown) which is deposited on top of the grate element 1. On its passage through the gas channels 8, the cooling gas will cool down the slats 5, 7 and due to the peculiar construction of the path of the channels 8 the cooling gas will incur a certain pressure loss before the gas is directed up through the clinker material by the last sections of the channels 8.

In FIGS. 1 and 2, the last section 7 of the channels 8 is placed perpendicular to the surface of the grate element, but this section 7 may also be terminated at a different angle in relation to the surface, and may, for example, lead the gas forward in the direction of movement of the material or backwards in counterflow with the direction of movement of the material, or it may have different angles so that the gas is dispersed in different directions.

The arrangement of the grate element shown in FIG. 4 is essentially similar to the grate element in FIG. 1, being provided with the same references as in the former figures. As it appears, the slats 5, which form the active surface 2, are in this embodiment placed between the end walls 3 of the grate element 1 in such a manner that they extend longitudinally in the direction of movement of the material. The operating principle of this grate element is identical to that in FIG. 1.

I claim:

1. A grate element for a grate surface such as in a clinker cooler, which grate element is shaped in the form of a box having two pairs of opposite facing side walls, an upper surface and a lower surface, between opposite walls of which a number of grate slats are mutually arranged and are spaced apart from each other, said grate slats having a grate-surface defining top surface, an under surface and side walls that extend substantially vertically between said top surface and said under surface, wherein at least one L-slat having an L-shaped cross section having a substantially vertically extending leg having an outer and an inner surface and a substantially horizontally extending leg is arranged between the same opposite walls of the grate elements as are the grate slats, with the upper portion of the vertically extending lea of the L-slat being located in the space between adjacent grate slats, with a portion of the outer surface of said vertically extending leg being in contact with a side wall of a first grate slat so that there is formed a fine gas slot between the inner surface of said vertically extending leg and a side wall of a grate slat adjacent to said first rate slat, with the substantially horizontally extending leg extending under both said gas slot and at least a portion of said adjacent grate slat for formation of a gas channel between the under surface of said adjacent grate slat and said horizontally extending leg.

2. A grate element according to claim 1, wherein the grate slats are cast in one piece with the walls of the grate element.

3. A grate element according to claim 1, wherein the grate slats are separately manufactured and fixed by means of suitable fastening means to the walls of the grate element.

4. A grate element according to claim 1, wherein the slats having an L-shaped profile are separately manufactured and fixed to the walls of the grate element and the grate slats by welding.

5. A grate element according to claim 1, wherein the last section of the channels is terminated at a different angle in relation to the surface other than perpendicular or extends in different directions.

6. A grate element according to claim 1, wherein the grate slats extend in the direction of movement of the material and are fixed to the end walls of the grate element.

7. A grate element according to claim 6, wherein the grate slats are cast in one piece with the walls of the grate element.

8. A grate element according to claim 6, wherein the grate slats are separately manufactured and fixed by means of suitable fastening means to the walls of the grate element.

9. A grate element according to claim 6, wherein the slats having an L-shaped profile are separately manufactured and fixed to the walls of the grate element and the grate slats by welding.

10. A grate element according to claim 6, wherein the L-shaped slats are provided at their free sides with longitudinal, projecting beads and/or the grate slats at their free sides are provided with corresponding longitudinal, descending beads.

11. A grate element according to claim 10, wherein the surfaces of the slats which are pointing towards the beads comprise recesses into which the beads protrude.

12. A grate element according to claim 6, wherein the last section of the channels is terminated at a different angle in relation to the surface other than perpendicular or extends in different directions.

* * * * *